US011234461B2

(12) United States Patent
Mansour

(10) Patent No.: US 11,234,461 B2
(45) Date of Patent: Feb. 1, 2022

(54) VERTICAL CIGAR DISPLAY

(71) Applicant: Remon Mansour, El Cajon, CA (US)

(72) Inventor: Remon Mansour, El Cajon, CA (US)

( * ) Notice: Subject to any disclaimer, the term of this patent is extended or adjusted under 35 U.S.C. 154(b) by 73 days.

(21) Appl. No.: 16/721,028

(22) Filed: Dec. 19, 2019

(65) Prior Publication Data

US 2021/0186096 A1 Jun. 24, 2021

(51) Int. Cl.

| | |
|---|---|
| ***A47F 3/14*** | (2006.01) |
| ***A47F 3/00*** | (2006.01) |
| ***A47F 7/00*** | (2006.01) |
| ***A47F 5/00*** | (2006.01) |
| ***A47F 3/06*** | (2006.01) |
| ***A24F 25/02*** | (2006.01) |
| ***A24F 15/20*** | (2006.01) |

(52) U.S. Cl.

CPC ..... *A24F 25/02* (2013.01); *A24F 15/20* (2013.01); *A47F 3/001* (2013.01); *A47F 3/063* (2013.01); *A47F 3/14* (2013.01); *A47F 5/0037* (2013.01); *A47F 7/0028* (2013.01)

(58) Field of Classification Search

CPC .. A24F 25/02; A24F 9/14; A24F 15/02; A24F 15/20; A24F 25/00; A47F 3/001; A47F 3/14; A47F 7/0028; A47F 7/0021; A47F 5/0081; A47F 5/0025; A47F 5/0037; A47F 1/00; A47F 3/06; A47F 3/063; B25H 3/003; A47B 81/00; A47B 81/005

USPC ..... 211/74, 60.1, 70.3, 69; 206/562, 204, 206/256, 564; 131/303, 329; 312/31, 312/31.2, 31.3, 45, 35, 122, 126, 128, 312/351

See application file for complete search history.

(56) References Cited

U.S. PATENT DOCUMENTS

| | | | | | |
|---|---|---|---|---|---|
| 804,487 | A | * | 11/1905 | Macarthy | A24F 25/02 312/31.3 |
| 950,689 | A | * | 3/1910 | Deeming | A24F 25/02 312/31.3 |
| 1,016,492 | A | | 2/1912 | Gunn | |
| 1,216,031 | A | | 2/1917 | Wilcox | |
| 1,678,260 | A | | 7/1928 | Martino et al. | |
| 1,683,851 | A | | 9/1928 | Wells | |
| 1,712,024 | A | * | 5/1929 | Brogden | B65H 49/38 312/31 |
| 1,841,267 | A | | 1/1932 | Koch | |
| 1,843,514 | A | * | 2/1932 | Levy | A24F 25/02 312/31.3 |
| 1,913,921 | A | | 6/1933 | Eastwood | |
| 1,954,013 | A | | 4/1934 | Lilienfield | |
| 2,058,800 | A | | 4/1934 | Jasper | |

(Continued)

OTHER PUBLICATIONS

Acryl China Co. Ltd. "Clear acrylic e-cigarette display racks stands/acrylic display stand/e-cigars holders." http://www.acrylchina.com/acrylic-display-stand/electronic-prodcts-display/clear-acrylic-e-cigarette-display-racks.html (downloaded Jul. 12, 2019).

*Primary Examiner* — Jennifer E. Novosad

(74) *Attorney, Agent, or Firm* — Loza & Loza LLP; Kevin Soules

(57) ABSTRACT

A method, system, and apparatus for displaying tobacco products comprises an enclosure and at least one product tray inside the enclosure, the product tray comprising a base, a frame formed around the base, and a series of display bars disposed in the frame, the display bars including a series of product stand holes for displaying the tobacco products individually and vertically.

20 Claims, 11 Drawing Sheets

(56) References Cited

U.S. PATENT DOCUMENTS 2,050,140 A * 8/1936 Ward ..... A47B 63/00 312/31.3
2,401,161 A * 5/1946 Joel ..... A24F 9/14 312/299
2,427,218 A * 9/1947 Liebson ..... A24F 15/06 312/73
2,506,191 A * 5/1950 Bayuk ..... A24F 25/02 312/31.3
2,611,491 A 8/1950 Lewis
2,568,089 A * 9/1951 Pendleton ..... B01L 9/06 211/69
2,681,262 A * 6/1954 Vincent ..... A47B 81/007 312/118
2,781,918 A * 2/1957 Palm, Jr. ..... A47F 1/12 211/128.1
2,818,979 A * 1/1958 Rose ..... A61M 5/008 211/60.1
3,145,841 A * 8/1964 McGuire ..... A61J 7/0069 206/459.5
3,259,748 A * 7/1966 Lammers ..... G21F 5/015 250/507.1
3,300,055 A 1/1967 Rohr
3,306,689 A * 2/1967 Isaacson ..... B65D 67/02 312/199
3,351,210 A * 11/1967 Murcott ..... A61J 7/0069 211/74
3,357,597 A 12/1967 Groff
3,583,556 A * 6/1971 Wagner ..... B25H 3/02 206/373
3,716,284 A * 2/1973 Vogt ..... A47B 88/43 312/334.4
3,774,774 A 11/1973 Menkel
3,846,004 A * 11/1974 Relyea ..... A47B 67/02 312/209
3,942,852 A * 3/1976 Anthony ..... A47F 3/063 312/294
3,970,199 A * 7/1976 Marschak ..... A47B 87/0261 211/126.12
4,019,793 A * 4/1977 Gerding ..... A61G 12/001 312/209
4,518,208 A * 5/1985 Marder ..... A61G 12/001 211/74
4,538,736 A * 9/1985 Berger ..... A47F 7/0028 211/168
4,660,719 A * 4/1987 Peterson ..... B25H 3/003 206/372
4,947,984 A * 8/1990 Kaufman ..... A45C 11/34 206/1.7
5,222,610 A * 6/1993 Johansen ..... A47F 7/0028 211/170
5,496,103 A * 3/1996 Kozak ..... A47F 3/005 312/116
5,651,262 A * 7/1997 Pendergast ..... A47F 3/0495 236/44 A
5,794,771 A 8/1998 Krawec et al.
5,848,534 A * 12/1998 Stauffer ..... F25D 31/007 62/91
5,850,839 A 12/1998 Adami
5,878,882 A * 3/1999 Kohagura ..... B25H 3/02 206/379
D410,108 S 5/1999 Reed
5,905,653 A * 5/1999 Higham ..... G07F 17/0092 700/244
5,970,987 A * 10/1999 Barreiro, Jr. ..... A24F 25/02 131/328
6,006,903 A * 12/1999 Milone ..... A24F 25/02 206/204
6,047,701 A * 4/2000 Feldman ..... A24F 25/02 131/302
D435,143 S * 12/2000 Post, Jr. ..... D27/193
6,168,030 B1 * 1/2001 Morris ..... A47F 7/0028 211/13.1
6,283,291 B1 * 9/2001 Vasudeva ..... B25H 3/003 206/373
6,283,566 B1 * 9/2001 Doces ..... A47B 81/04 211/71.01
RE38,905 E * 12/2005 Wei ..... B25H 3/003 206/373
7,175,034 B2 2/2007 Nook et al.
D577,513 S * 9/2008 Walker ..... D6/675.5
8,448,646 B2 5/2013 Cooper
10,182,670 B2 1/2019 Pretotto
2003/0041868 A1 * 3/2003 Deloach ..... A24F 25/02 131/329
2007/0062891 A1 3/2007 Stievenard
2007/0163973 A1 * 7/2007 Smokowicz ..... F16M 11/041 211/70
2009/0050167 A1 2/2009 Wood
2010/0072150 A1 * 3/2010 Takashima ..... A47F 5/0025 211/59.3
2013/0118941 A1 5/2013 Wells
2016/0007744 A1 * 1/2016 Fasino ..... A47F 7/005 312/330.1
2020/0037661 A1 * 2/2020 Slate ..... A24F 25/02

* cited by examiner

VERTICAL CIGAR DISPLAY

TECHNICAL FIELD

Embodiments are generally related to product displays. Embodiments are further related to cigar displays. Embodiments are also related to humidors with integrated displays. Embodiments are additionally related to a systems and methods for displaying cigars in a humidor.

BACKGROUND

A humidor is a container configured to store tobacco products including cigars, cigarettes or pipe tobacco. A humidor is configured to control and maintain the humidity in the container to prevent negative effects on the products inside, which might result from too much or too little humidity. Humidors are configured with systems that store and release humidity. In most cases the preferred humidity level for a humidor is between 68%-75%.

Those in the business of cigar sales generally store cigars in wooden boxes. The boxes can be shelved in a humidor so that the box lids can remain open. This allows customers to browse the selection of cigars and select those they would like to purchase.

While this version of storage is acceptable it also has various downsides. First, cigar boxes tend to obfuscate the cigar rings on the products making it difficult to identify the cigar. In addition, the customer usually touches more than one of the cigars, which can serve as a vector for the spread of disease. Such displays often lack the aesthetics to encourage a customer to purchase a cigar.

Furthermore, traditional cigar boxes can hold differing numbers of cigars. When a consumer is browsing the products, it is very difficult for the store owner to monitor how many cigars have been removed from a box. Keeping track of how many cigars have been taken from a box is a challenge. Inventory monitoring is thus, a major challenge presented by standard cigar display systems.

Accordingly, there is a need in the art for improved methods, systems, and apparatuses for displaying tobacco products, as disclosed herein.

SUMMARY

The following summary is provided to facilitate an understanding of some of the innovative features unique to the embodiments disclosed and is not intended to be a full description. A full appreciation of the various aspects of the embodiments can be gained by taking the entire specification, claims, drawings, and abstract as a whole.

It is, therefore, one aspect of the disclosed embodiments to provide a method and system for displaying products.

It is another aspect of the disclosed embodiments to provide a system and apparatus for displaying tobacco products individually and vertically in a grid.

It is another aspect of the disclosed embodiments to provide a humidor configured with a series of product display shelves formed therein, the product display shelves being configured to display tobacco products.

The aforementioned aspects and other objectives and advantages can now be achieved as described herein. In one embodiment, a system and/or apparatus for displaying tobacco products comprises an enclosure and at least one product tray inside the enclosure, the product tray comprising a base, a frame formed around the base, and a series of display bars disposed in the frame, the display bars including a series of product stand holes for displaying the tobacco products individually and vertically. The individual and vertical arrangement of tobacco products allows a store owner to easily monitor which cigars have been selected by consumers, and allows the store owner to track inventory.

In an embodiment, a product display system comprises a base, a frame formed around the base, and at least one display bar configured to sit on the base and inside the frame formed around the base, the display bar further comprising at least one tubular channel, the tubular channel being configured to hold a product for display.

In an embodiment, the at least one tubular channel comprises a plurality of tubular channels formed in a row on each of the plurality of display bars. In an embodiment the depth of each of the plurality of tubular channels decreases sequentially from the front tubular channel to the back tubular channel among the plurality of tubular channels. The at least one tubular channel can be configured to have a diameter sized to fit a tobacco product.

In an embodiment, the system includes a plurality of display bars, wherein the base and the frame are sized to house the plurality of display bars. The plurality of display bars are arranged in the frame formed around the base such that the plurality of tubular channels form a grid of tubular channels. The base further comprises a plurality of slats.

In another embodiment, the system includes a humidor wherein the base, the frame formed around the base, and the at least one display bar are housed in the humidor. In this case, the frame can further comprise a first side rail, the first side rail having a first connecting arm mounted thereon, the first connecting arm configured to interface with a first mounting rail mounted in the humidor; and a second side rail, the second side rail having a second connecting arm mounted thereon, the second connecting arm configured to interface with a second mounting rail mounted in the humidor.

In another embodiment, a product display system comprises a humidor, and an extendable display tray mounted in the humidor, the extendable display tray further comprising: a base, a frame formed around the base, and a plurality of display bars arranged inside the frame formed around the base, each of the plurality of display bars comprising a row of tubular channels, each of the tubular channels being configured to hold a cigar vertically. The system can include a first connecting arm mounted to a side of the frame, the first connecting arm configured to interface with a first mounting rail mounted in the humidor, and a second connecting arm mounted to an opposing side of the frame, the second connecting arm configured to interface with a second mounting rail mounted in the humidor. In an embodiment, the depth of each of the plurality of tubular channels decreases sequentially from a front tubular channel among the plurality of tubular channels to a back tubular channel among the plurality of tubular channels. In an embodiment, the base, the frame formed around the base, and the plurality of display bars arranged inside the frame formed around the base are made of wood. In an embodiment, the diameter of the tubular channels in each of the mounting blocks is different.

In another embodiment, a product display system comprises an enclosure and at least one product tray inside the enclosure, the product tray comprising: a base, a frame formed around the base, and at least one top sheet extending between two edges of the frame, the at least one top sheet having at least one product stand hole formed therein. The enclosure can be transparent. In an embodiment, a humidifier can be disposed in the enclosure. In an embodiment, the system can include a plurality of top sheets each of the plurality of top sheets extending between the two edges of the frame. In an embodiment, the enclosure can include at least two shelves formed inside the enclosure, wherein each of the at least two shelves houses one of the at least one product trays.

BRIEF DESCRIPTION OF THE DRAWINGS

The accompanying figures, in which like reference numerals refer to identical or functionally-similar elements throughout the separate views and which are incorporated in, and form a part of, the specification, further illustrate the embodiments and, together with the detailed description, serve to explain the embodiments disclosed herein.

DETAILED DESCRIPTION

Figure 1A:
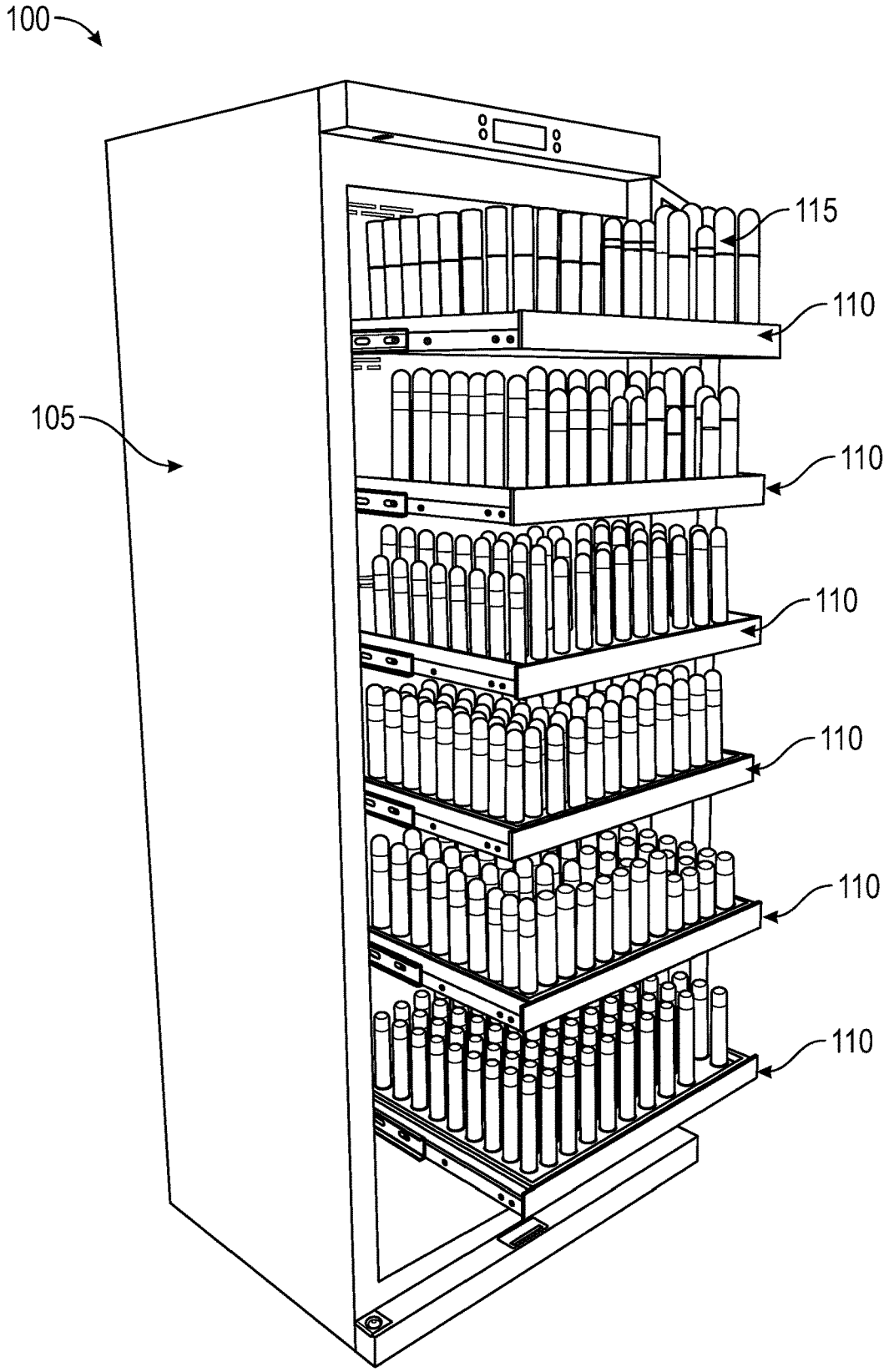
FIG. 1A depicts a product display system, in accordance with the disclosed embodiments.

The particular values and configurations discussed in the following non-limiting examples can be varied, and are cited merely to illustrate one or more embodiments and are not intended to limit the scope thereof.

Example embodiments will now be described more fully hereinafter with reference to the accompanying drawings, in which illustrative embodiments are shown. The embodiments disclosed herein can be embodied in many different forms and should not be construed as limited to the embodiments set forth herein; rather, these embodiments are provided so that this disclosure will be thorough and complete, and will fully convey the scope of the embodiments to those skilled in the art. Like numbers refer to like elements throughout.

The terminology used herein is for the purpose of describing particular embodiments only and is not intended to be limiting. As used herein, the singular forms "a", "an", and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Throughout the specification and claims, terms may have nuanced meanings suggested or implied in context beyond an explicitly stated meaning. Likewise, the phrase "in one embodiment" as used herein does not necessarily refer to the same embodiment and the phrase "in another embodiment" as used herein does not necessarily refer to a different embodiment. It is intended, for example, that claimed subject matter include combinations of example embodiments in whole or in part.

In general, terminology may be understood at least in part from usage in context. For example, terms, such as "and", "or", or "and/or," as used herein may include a variety of meanings that may depend at least in part upon the context in which such terms are used. Typically, "or" if used to associate a list, such as A, B or C, is intended to mean A, B, and C, here used in the inclusive sense, as well as A, B or C, here used in the exclusive sense. In addition, the term "one or more" as used herein, depending at least in part upon context, may be used to describe any feature, structure, or characteristic in a singular sense or may be used to describe combinations of features, structures or characteristics in a plural sense. In addition, the term "based on" may be understood as not necessarily intended to convey an exclusive set of factors and may, instead, allow for existence of additional factors not necessarily expressly described, again, depending at least in part on context.

Unless otherwise defined, all terms (including technical and scientific terms) used herein have the same meaning as commonly understood by one of ordinary skill in the art. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The embodiments disclosed herein are drawn to methods, systems, and apparatuses for displaying products, and in particular for systems and methods to vertically display cigars, cigarettes, and other tobacco products in a humidor.

The systems disclosed herein can include a tray comprising a product tray with a grid of cigar sized holes. The product tray can be used to hold a selection of tobacco products vertically. The system further includes an associated apparatus for mounting one or more of the trays in a humidor, so that the tobacco products can be individually and vertically displayed in the humidor.

FIG. 1A illustrates a product display system 100. The product display system 100 generally comprises a humidor 105, and a series of extendable display trays 110, for displaying products 115. As illustrated in FIG. 1A, the series of extendable display trays 110 can be organized in the humidor 105, at various vertical locations in the humidor 105. The extendable display trays 110, can be configured to display individual products, which can be cigars, cigarettes, or other such tobacco products, vertically, so that a consumer can peruse and select a product for purchase.

Figure 2A:
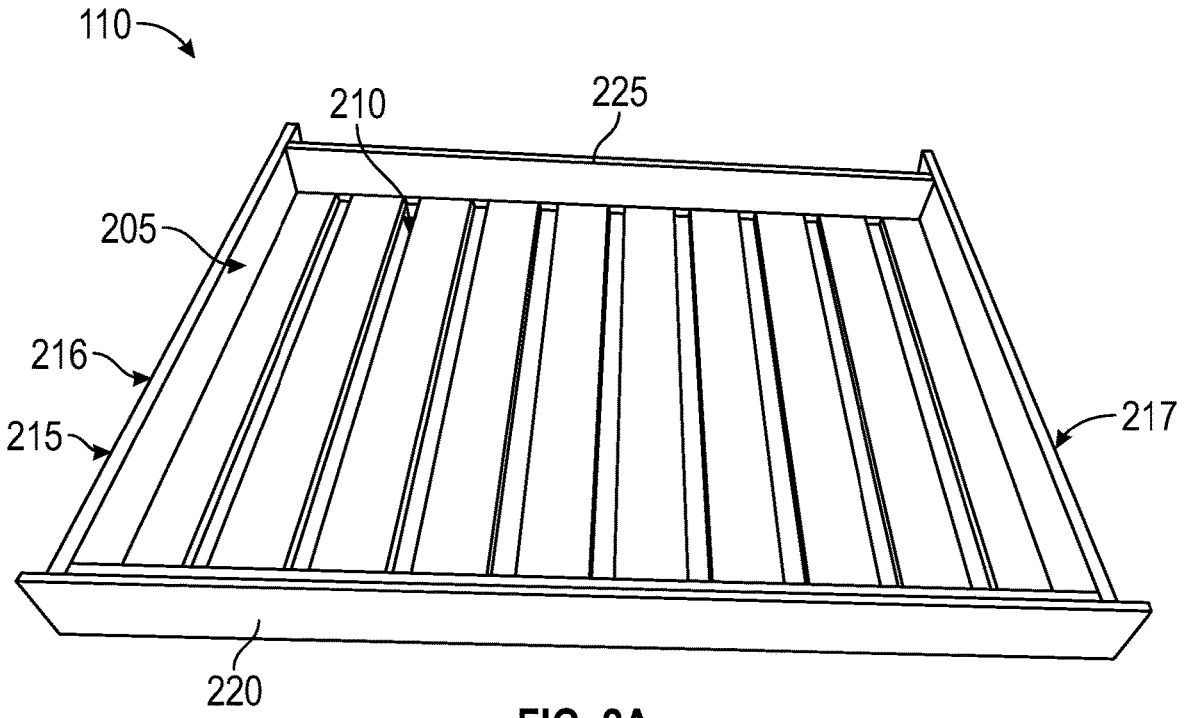
FIG. 2A depicts aspects of an extendable display tray in accordance with the disclosed embodiments.
Figure 2B:
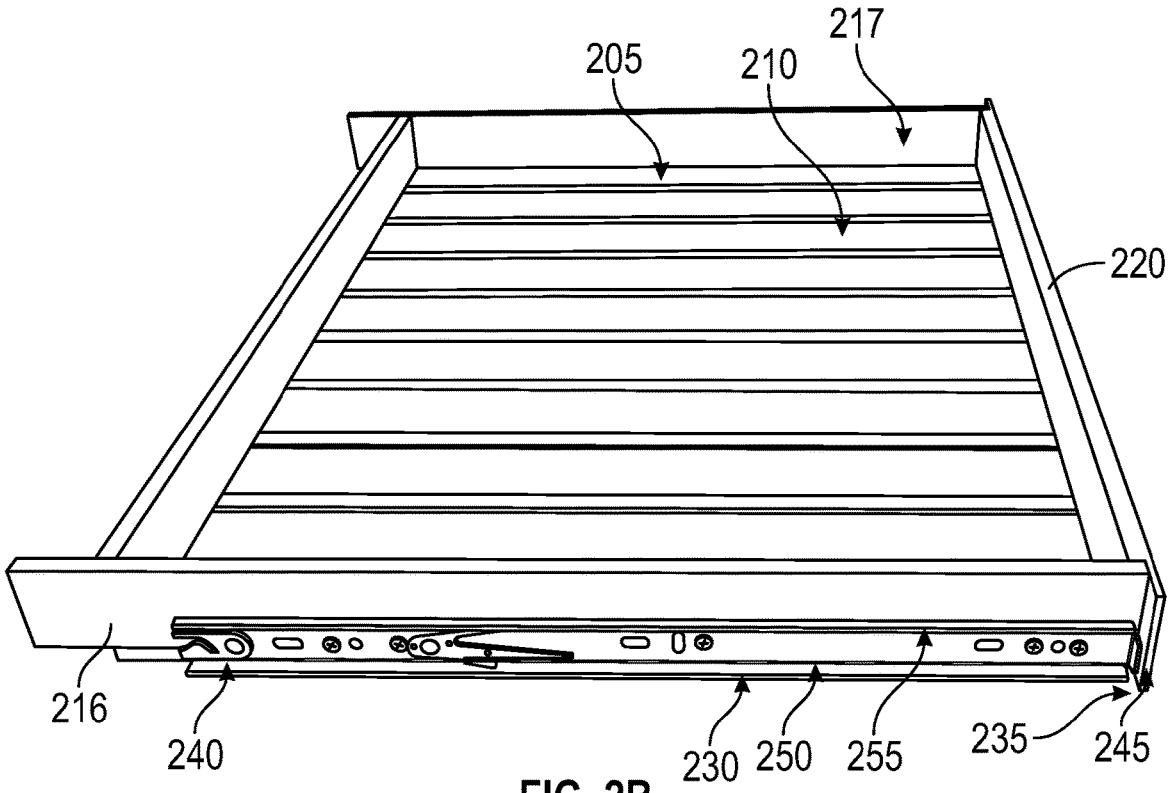
FIG. 2B depicts a side view of an extendable display tray in accordance with the disclosed embodiments.

The humidor 105 is further illustrated in FIG. 2B. As illustrated the humidor 105 can generally comprise an enclosure 150. The enclosure 150 can include a transparent door on its front side 155. The humidor 105 can thus be enclosed and sealed. The ability to seal the interior of the humidor from external conditions is important to maintain the tobacco products at the desired temperature and humidity. The humidor 105 includes various units that require electric power, and can therefore include a power cord for connecting to a power source or a battery.

The humidor 105 can include lights 160 that can run along the internally facing sides of the walls of the humidor. The lights 160 illuminate the tobacco products 115 displayed in the humidor 105.

The humidor 105 can further include a temperature and humidity control module 165 which can be used to set the interior environment of the humidor to a desired temperature and humidity level. The temperature and humidity control module can include a display 170 illustrating the current temperature and humidity level in the humidor 105. The humidor can include a temperature control mechanism which can be embodied as a heat pump, compressor, or other such temperature control component. The humidor can also have a humidifier 175 configured on the interior floor 180 of the humidor 105. The humidor serves to maintain the internal humidity level inside the enclosure 150.

Figure 1B:
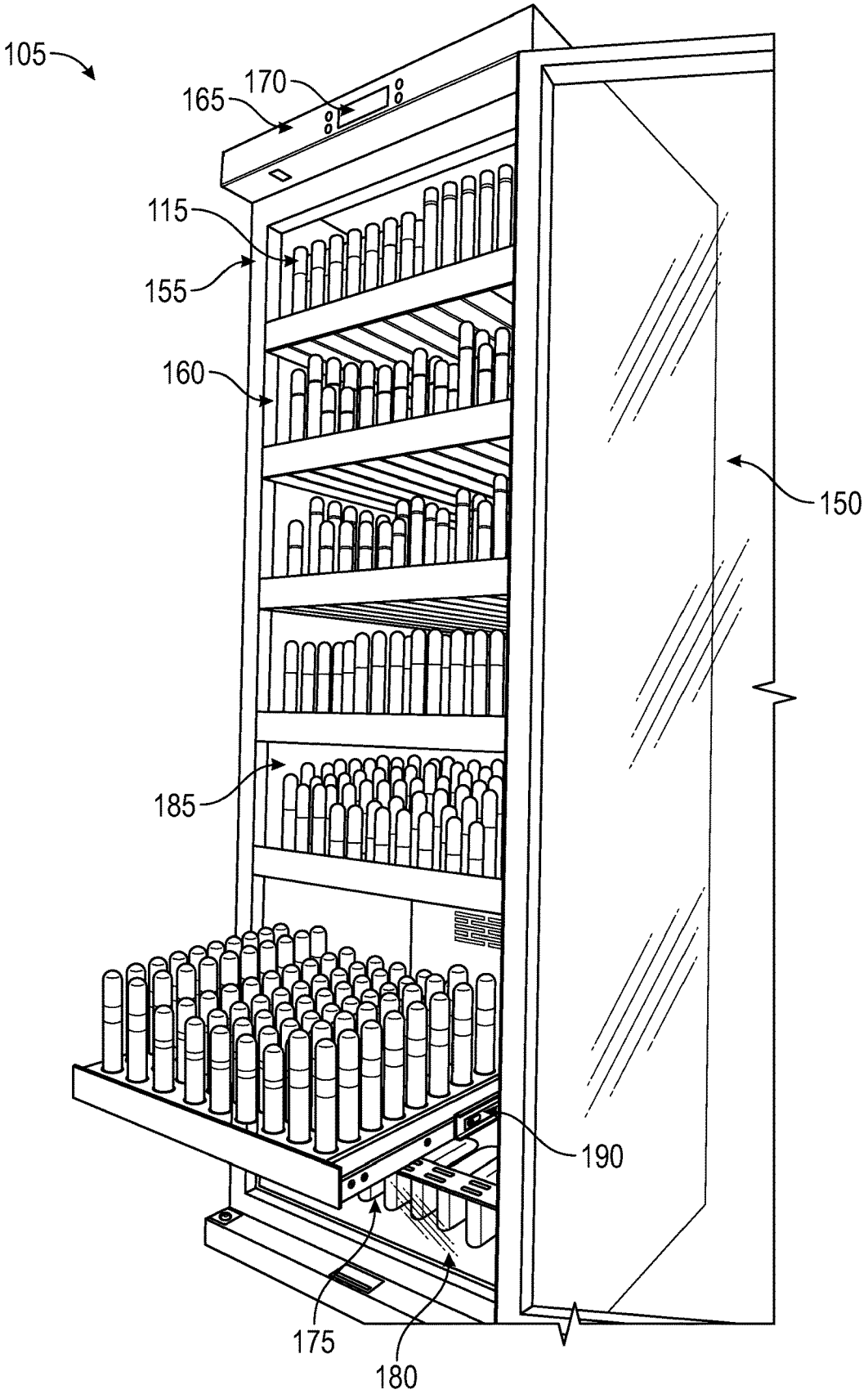
FIG. 1B depicts another view of a product display system, in accordance with the disclosed embodiments.

The interior walls 185 of the humidor 105, can be configured with mounting rails 190. The mounting rails 190 are configured to interface with connecting arms formed on the display trays 110. For each display tray 110, two mounting rails 190 can be mounted at substantially the same vertical position on opposing interior walls 185 of the humidor 105. The connecting arms formed on sides of the display tray 110, can engage the mounting rails 190 to hold the display tray 110 in place. The arrangement allows the display tray 110 to be pulled from the interior of the enclosure into an extended position, so that a product can be selected and removed from the display tray 110, and then pushed back into its closed position in the humidor 105. In FIG. 1B, one display tray 110 is illustrated in an extended position (pulled out from the humidor 105), while the remaining display trays 110 remain in their closed position.

Aspects of an extendable display tray 110 are illustrated in FIG. 2A. The extendable display tray 110 can comprise a base 205. In some embodiments, the base 205 can comprise a series of slats 210. The slats 210 are configured to allow loose tobacco particles to filter out of the base 205 for easy collection. In other embodiments, the base 205 can be a single piece.

The base 205 is enclosed by a frame 215. The frame 215 includes two side rails, side rail 216 and side rail 217. The front 220 of the extendable display tray 110 can be connected to the side rail 216 and side rail 217. The rear 225 of the frame 215 is also connected to the side rail 216 and side rail 217. The base 205 and frame 215 thus form an open-topped tray.

FIG. 2B illustrates a side perspective of the extendable display tray 110. From this perspective, a connecting arm 230 can be seen installed on side rail 216. It should be appreciated that the side rail 217 can similarly have a connecting arm 230 mounted thereon, although the connecting arm is not visible on side rail 217 from the perspective illustrated in FIG. 2B.

The connecting arm 230 can include an end stop 240 at one end, and a mounting tab 235 on the other end. The mounting tab 235 comprises a tab that can be connected to an end 245 of the front 220 of the display tray 110. The connecting arm 230 can include an upper rib 250 and a lower rib 255. The ribs are configured to house a roller mounted on an internal side of a wall of the humidor (or other such enclosure), such that the roller or slide that can facilitate movement of the connecting arm 230 when it is engaged to the mounting rail 190, between the upper rib 250 and lower rib 255. The end stop 240 can prevent the extendable display tray 110 from being pulled out of its extended position in the humidor 105, or other enclosure.

Figure 3A:
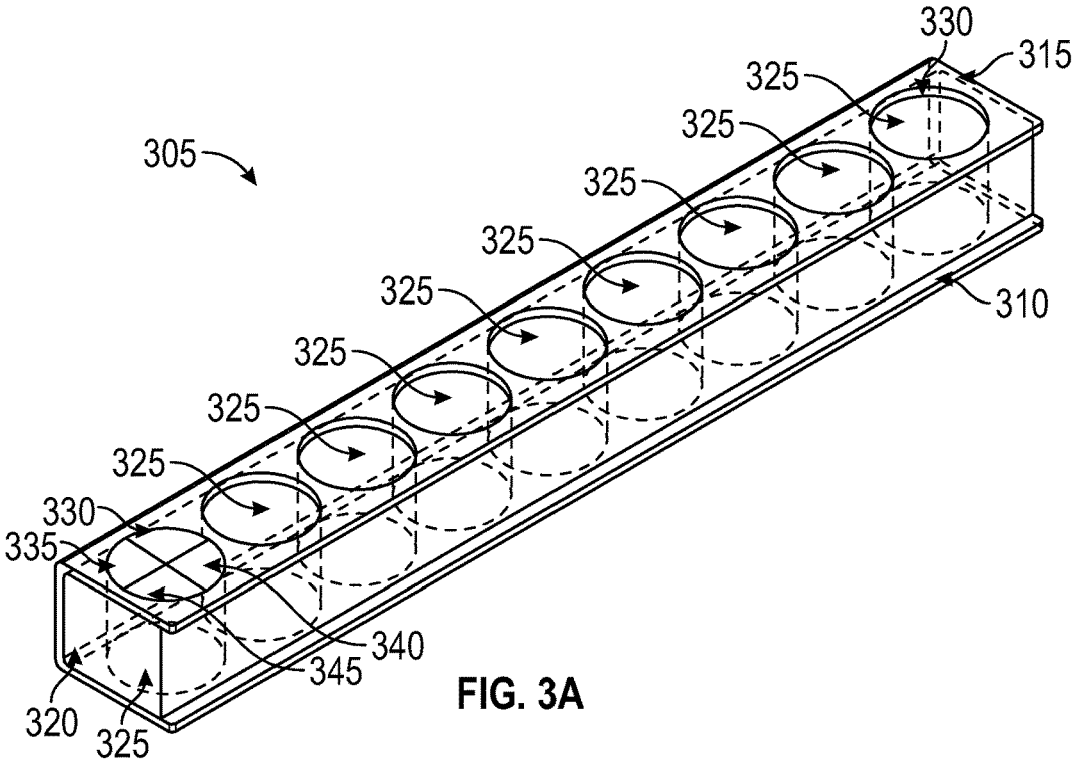
FIG. 3A depicts aspects of a display bar, in accordance with the disclosed embodiments.

The extendable display tray 110 can further include a plurality of display bars 305. One such display bar 305 is illustrated in FIG. 3A. The display bar 305 can comprise a bottom stop 310 and a top layer 315. The bottom stop 310 and top layer 315 bookend a product block 320. The product block 320 can comprise a structure through which a series of one or more tubular channels 325 are formed. The top layer 315 can include a series of openings (e.g. opening 330) that align with the tubular channels 325 formed in the product block 320.

Each of the openings 330, and the tubular channels 325, are configured to allow a tobacco product to stand upright in the display bar 305. In certain embodiments, the tobacco product can comprise a cigar, cigarette, or other such product. The circumference of the openings 330 and/or the tubular channels 325 can therefore be sized to fit such products. In some cases, each of the display bars 305 can have a row of tubular channels 325 where each of the tubular channels 325 has a different diameter so that different sized tobacco products will fit in each display bar 305. In other embodiments, each of the tubular channels 325 in a given display bar 305 can have the same diameter. In still other embodiments, each of the tubular channels 325 in a given display bar can have the same diameter but each respective display bar 305 can have a set of tubular channels 325 with a diameter that differs from the diameter of the tubular channels 325 in the other display bars 305. This allows the system to accommodate products of various diameters.

In certain embodiments, the depth of each of the plurality of tubular channels 325 can decrease sequentially from the front tubular channel 325 to the back tubular channel 325 among the plurality of tubular channels 325. In this way, the products displayed in the front tubular channel 325 will be slightly lower than the product behind it, so that all of the products are visible. In certain embodiments, the depth of the tubular channels 325 can further be selected to create more complex patterns or designs in the respective heights of the products 115 displayed therein.

In other embodiments, the shape of the tubular channels can be selected to ensure that the product stands in a substantially vertical "standing" position in the display bar 305. Thus, in certain embodiments, the tubular channels 325 can be conically shaped such that the end of the tubular channel 325 nearer to the bottom stop 310 has a narrower diameter, than at the opposing end, nearer to the top layer 315. In this way, the tubular channels 325 can each hold tobacco products irrespective of the diameter of the product (assuming that the diameter of the product is smaller than the diameter of the top of the tubular channel.

Similarly, in certain embodiments, a cover 335 can be formed on one or more of the openings 330. The cover 335 can comprise a rim 345 and a series of flaps 340. The flaps can be formed of a material that is flexible. The flaps 340 can allow a tobacco product to be inserted into the opening 330. The flex in the flaps can serve to hold the tobacco product 115 in its place vertically in the tubular channels 325.

In certain embodiments, the bottom stop 310 can comprise a base plate that can be slid into and out of position on the bottom of the display bar 305. The base plate can be held in position in a slot formed in the bottom side of the product block 320. This embodiment allows the bottom stop 310 to be removed so that residual tobacco material that has fallen in the tubular channels 325 can be removed and the tubular channel 325 can be cleaned, by removing the base plate, emptying the residual product, and then replacing the base plate onto the bottom of the product block 320, in place in the slot formed in the product block 320. In other embodiments, the bottom stop 310 can be removed entirely from the display bar 305.

Figure 3B:
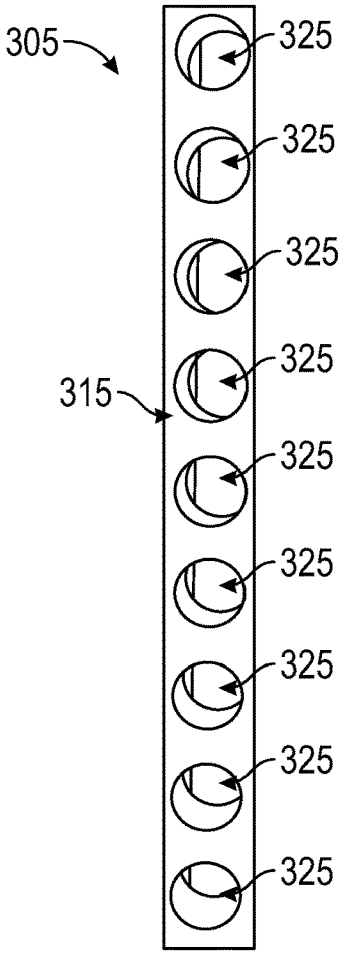
FIG. 3B depicts a top view of a display bar, in accordance with the disclosed embodiments.

FIG. 3B illustrates a top plan view of the display bar 305. From this view it is possible to see the base plate partially removed from the bottom of the display bar 305, below the tubular channels 325.

Figure 4A:
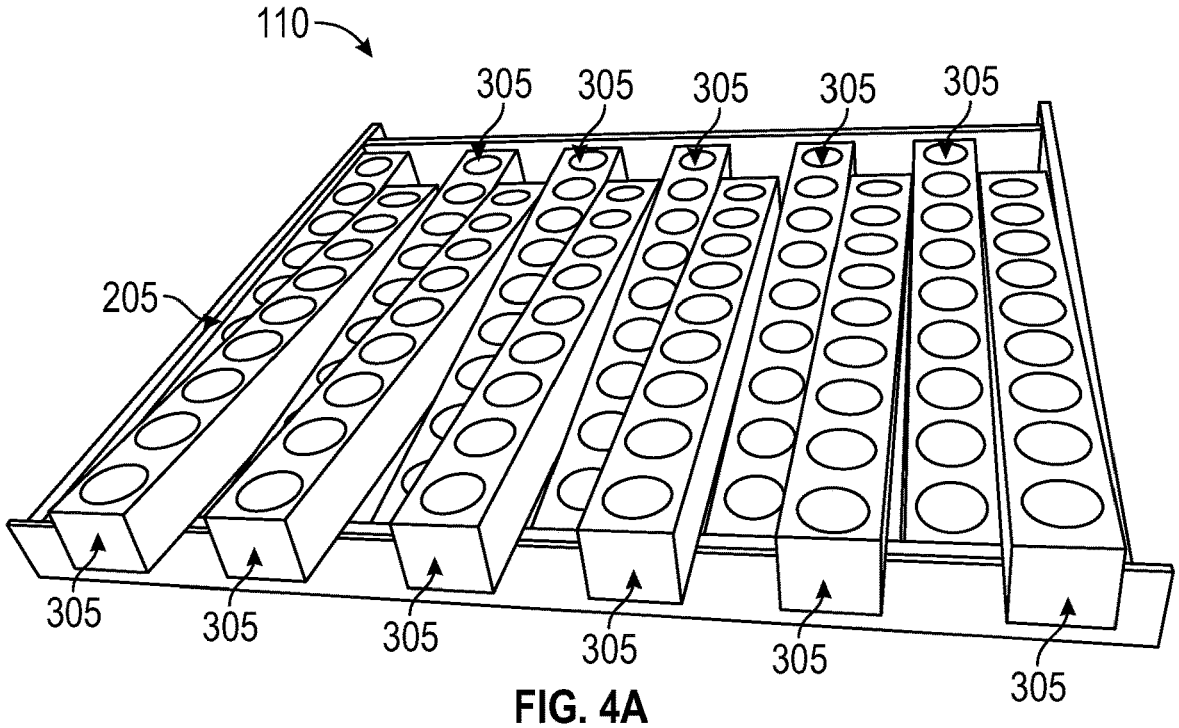
FIG. 4A depicts aspects of an extendable display tray, in accordance with the disclosed embodiments.

FIG. 4A illustrates a selection of display bars 305 being installed in the extendable display tray 110. The display tray 110 is configured to house a series of display bars 305 side by side. The display tray 110 can be sized to fit a set number of display bars 305 based on the width of the display bars 305. In FIG. 4A, twelve display bars 305 are illustrated in the display tray 110, but in other embodiments, the display tray 110 can be sized to fit different numbers and sizes of display bars 305.

Figure 4B:
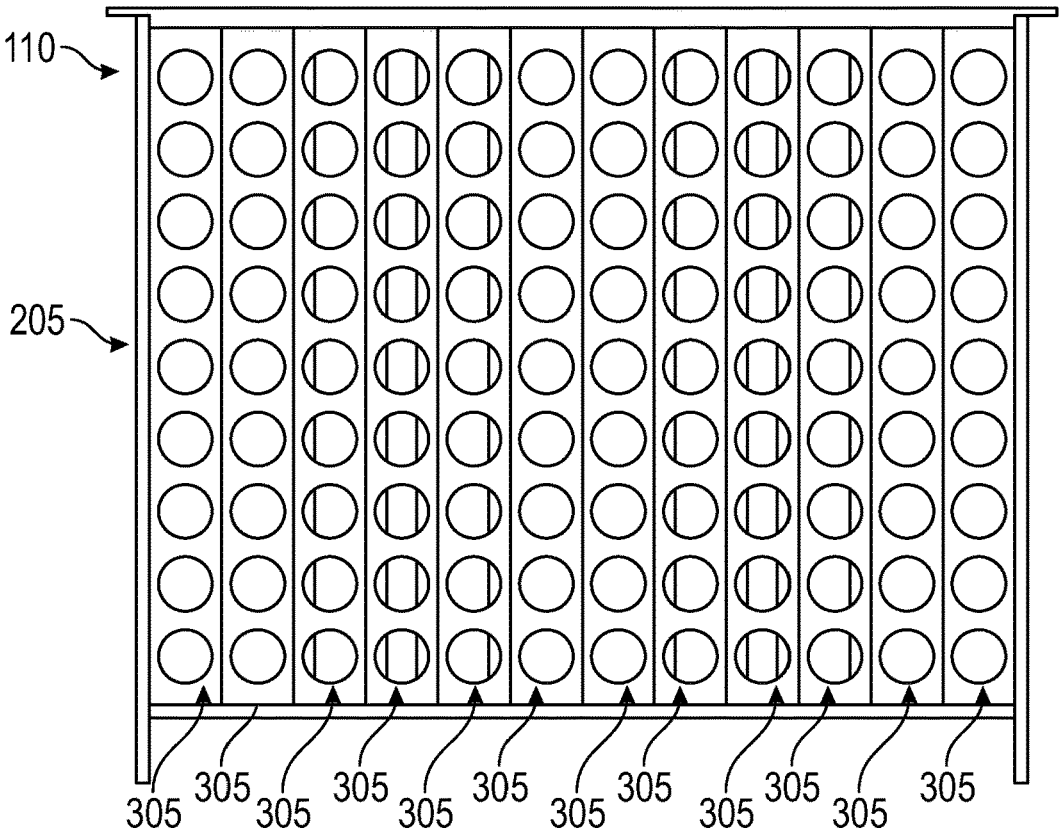
FIG. 4B depicts a top view of an extendable display tray with display bars disposed therein, in accordance with the disclosed embodiments.

FIG. 4B illustrates a top plan view of a display tray 110 with twelve display bars 305 mounted therein. As illustrated in FIG. 4B a plurality of display bars 305 can be fitted into the frame 215 so that the tubular channels 325 form an array or grid of openings, where a tobacco product can be vertically displayed.

Figure 4C:
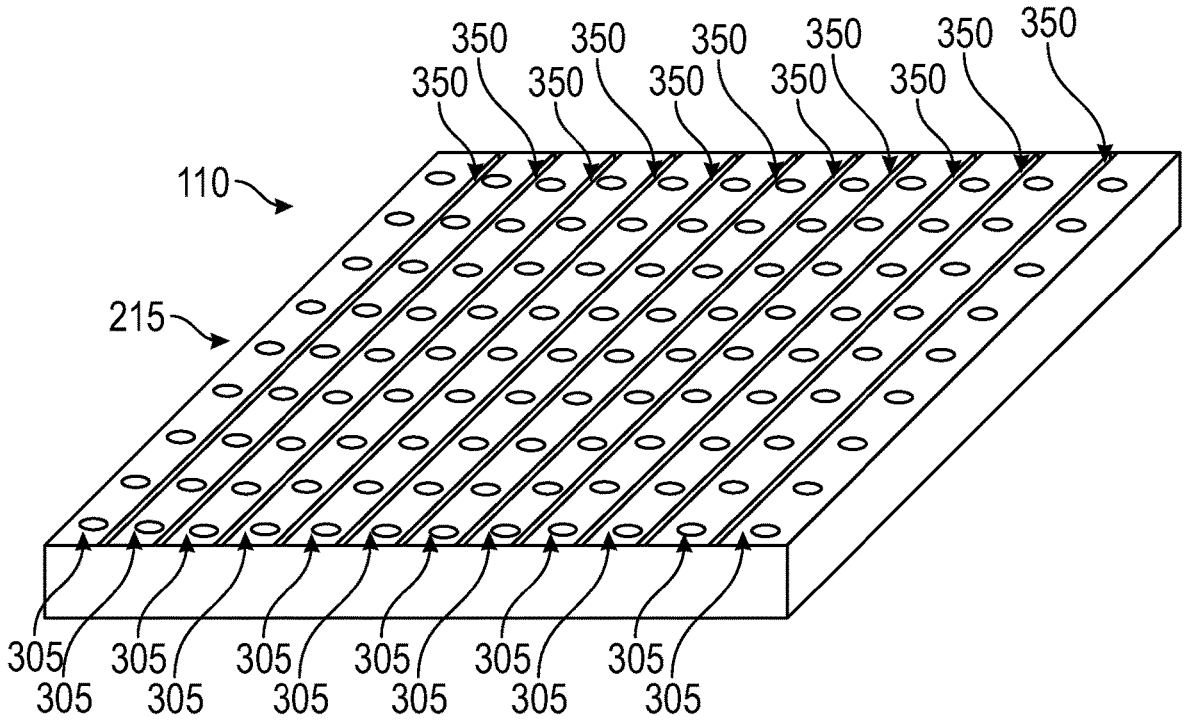
FIG. 4C depicts another embodiment of an extendable display tray, in accordance with the disclosed embodiments.
Figure 4D:
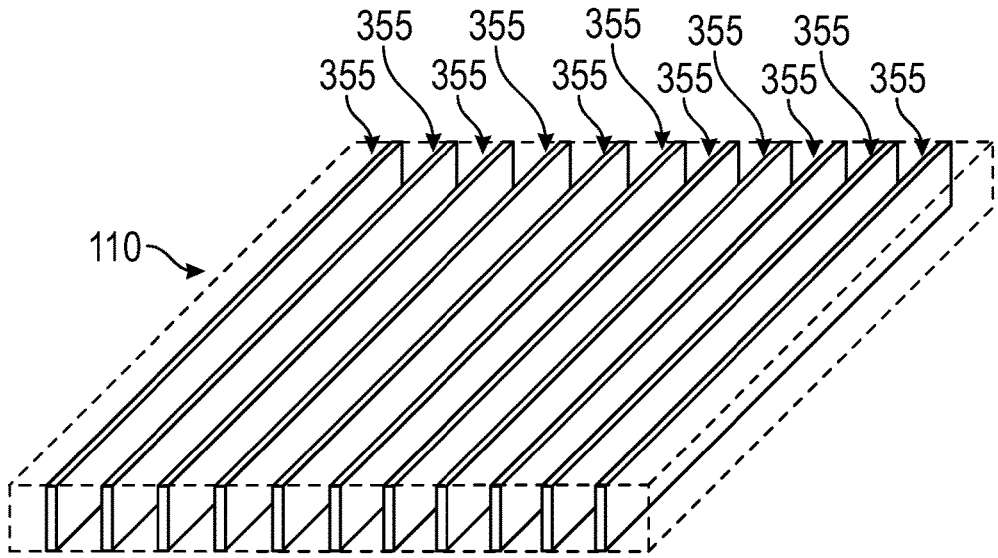
FIG. 4D depicts a top view of an extendable display tray with separator fins, in accordance with the disclosed embodiments.

FIG. 4C and FIG. 4D illustrate an alternative embodiment of the display tray 110. In the embodiment, illustrated in FIG. 4C and FIG. 4D, a series of separators 350 can be inserted into the frame 215. The separators 350 are configured to establish spacing between the display bars 305. The separators 350 can each comprise a thin top rail as shown in FIG. 4C, or as shown in FIG. 4D, can comprise a thin fin 355. The separators 350 establish even spacing between the display bars 305.

Figure 4E:
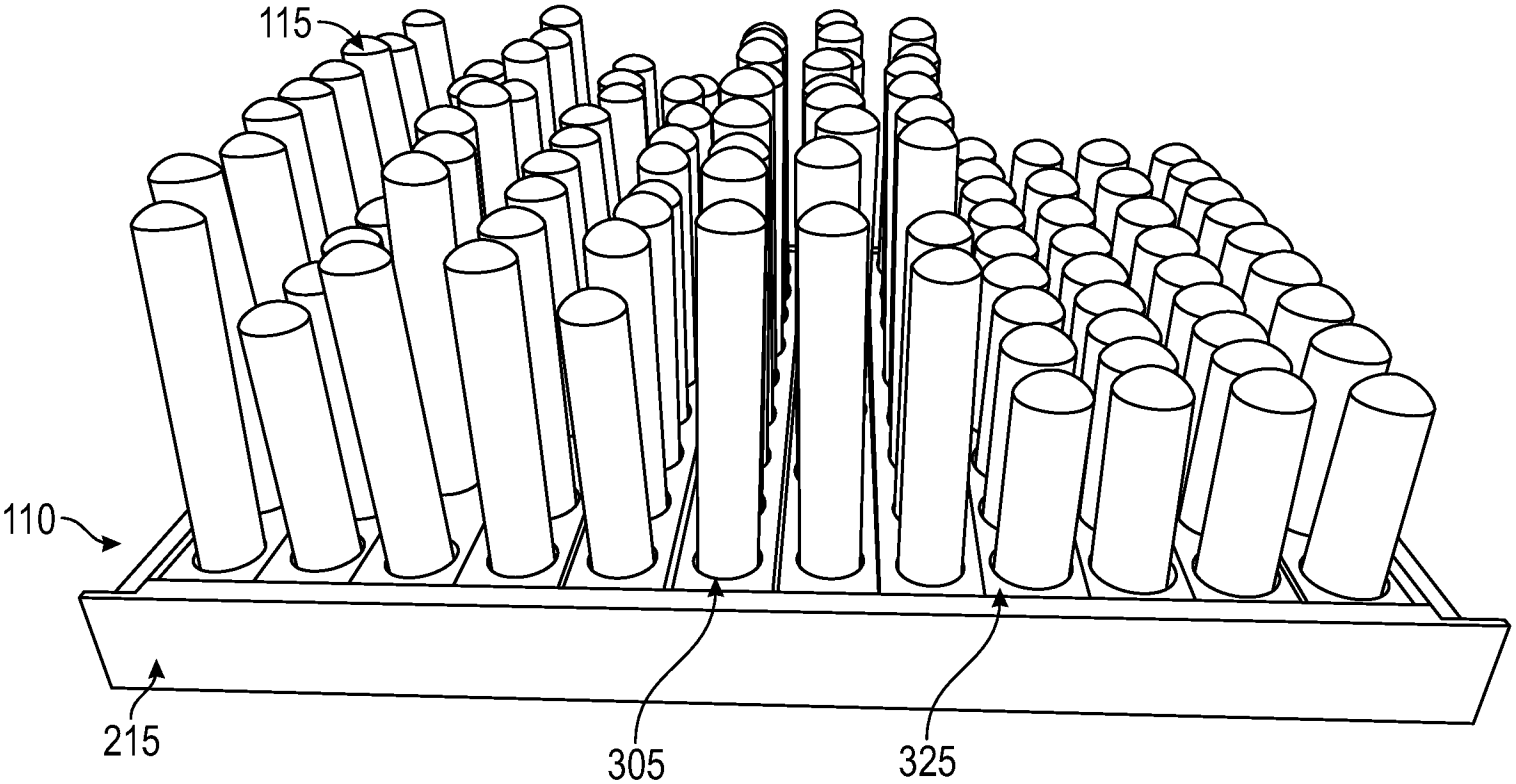
FIG. 4E depicts an extendable display tray displaying a product, in accordance with the disclosed embodiments.

FIG. 4E illustrates a display tray 110 filled with product 115. The product display tray 110 includes the display bars 305 with tubular channels 325 formed in rows on each of the display bars 305. The base 205 and frame 215 can be sized to house the plurality of display bars 305. In certain embodiments, the product 115 can comprise tobacco products including cigars, cigarettes, or other products. The tubular channels 325 can be configured to have a diameter sized to fit the tobacco products. The display bars 305 are arranged in the frame 215 formed around the base 205 such that the plurality of tubular channels 325 form a grid of tubular channels. As illustrated the products 115 can be inserted into the tubular channels 325 so that the products 115 stand vertically in the display tray 110.

In an embodiment the display tray 110 including the base, the frame formed around the base, and the plurality of display bars arranged inside the frame can be formed of wood. The wood structure provides a desirable aesthetic quality, but also preserves natural aromas and flavors associated with the product, and helps prevent moisture from accumulating on the product. In certain embodiments, the wood can be selected to be cedar such as Spanish cedar for its aesthetics and preferable aroma. It should be appreciated that, in other embodiments, the components disclosed herein can be formed from molded foam, metal, plastic, hard rubber, or combinations thereof.

Figure 5:
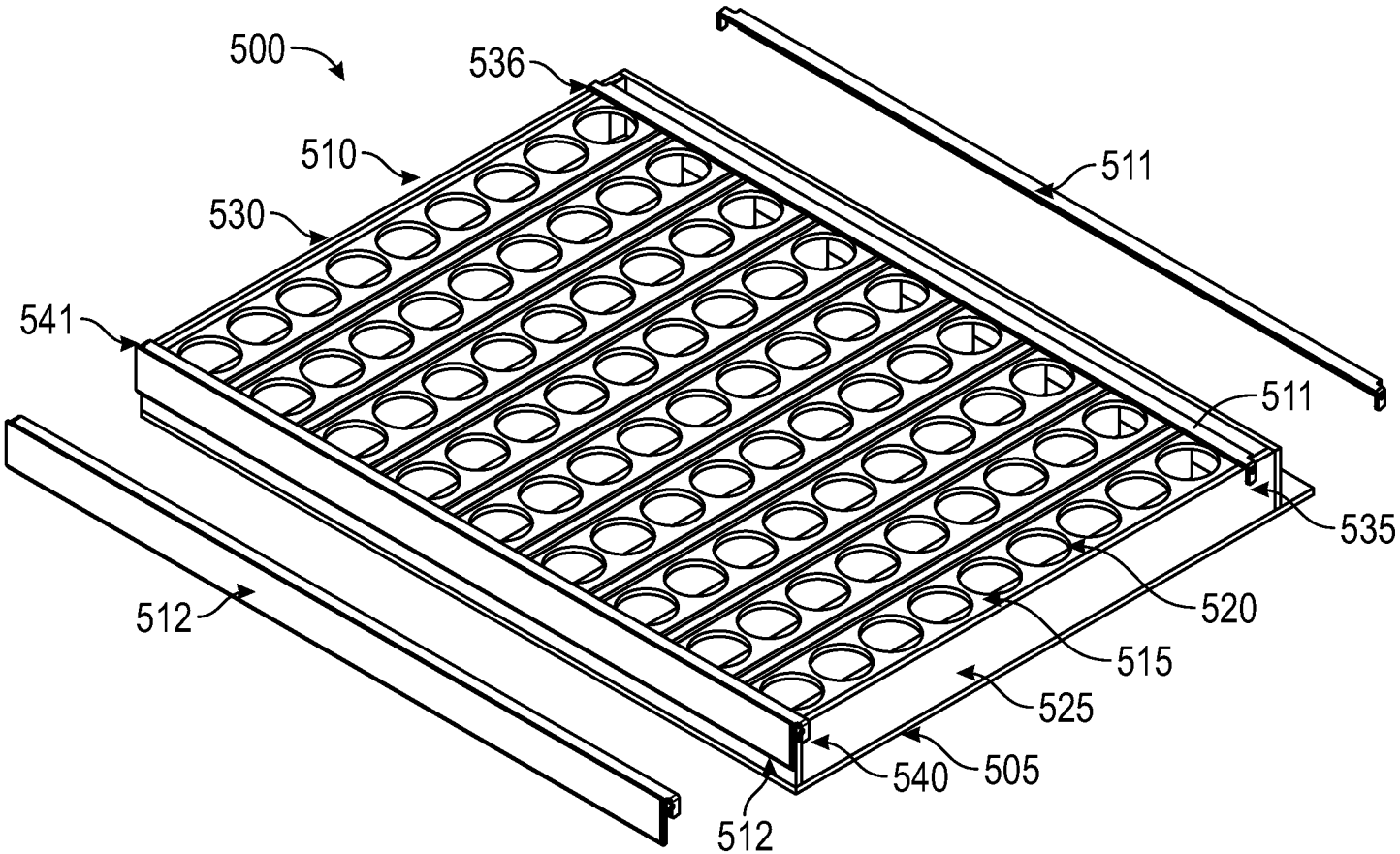
FIG. 5 depicts an alternative embodiment of a display tray, in accordance with the disclosed embodiments.

FIG. 5 illustrates an alternative embodiment of a product display tray 500. In the embodiment illustrated in FIG. 5, the product display tray 500 comprises a modular arrangement that can be assembled into a tray for displaying tobacco products. The product display tray 500 generally includes a base 505, a frame 510 formed around the base, and a series of top sheets 515, extending between two edges, side edge 511 and side edge 512, of the frame 510. Each of the top sheets 515 have a row of product stand holes 520 formed therein.

It should be appreciated that, in certain embodiments, a series of top sheets 515 can be disposed across the top of the display tray 500. The series of top sheets 515 sit side by side such that they form a grid of product stand holes 520. The spacing between the product stand holes 520 on each top sheet 515 can be identical, which will result in a uniform grid of product stand holes. In other embodiments, the spacing between the product stand holes 520 on the various top sheets 515 can be varied such that the product stand holes are configured into a design (e.g. concentric circles, triangles, arrangement into words, or other such shapes).

In other embodiments, the top sheet 515 can comprise a single top sheet that fits over the frame 510 and includes an array of product stand holes 520. In this embodiment, the location of the product stand holes 520 can be selected as a uniform grid, or can be selected to be another shape including a diamond, concentric circles, letters, etc.

As illustrated in FIG. 5, the side edge 511 can be removed and replaced in position between the side wall 525 and side wall 530, by snapping it into place in the mounting slot 535 formed in the side wall 525, and the mounting slot 536 formed in the side wall 530. Similarly, the side edge 512 can be removed and replaced in position between the side wall 525 and side wall 530, by snapping it into place in the mounting slot 540 formed in the side wall 525, and the mounting slot 541 formed in the side wall 530.

Figure 6:
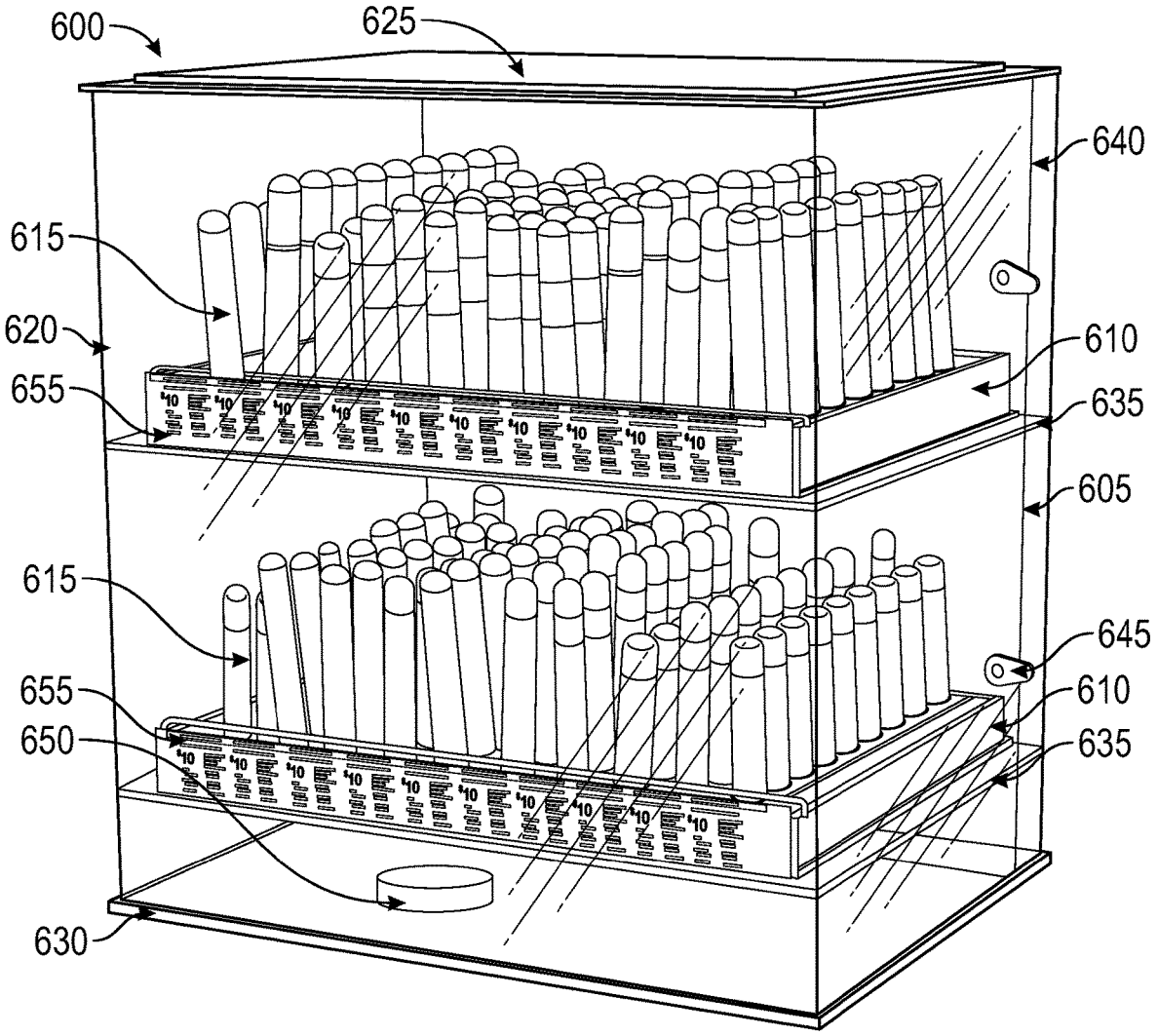
FIG. 6 depicts an alternative embodiment of a product display system, in accordance with the disclosed embodiments.

FIG. 6 illustrates another embodiment of a product display system 600. The product display system 600 can be a cigar display system 600, but in other embodiments the system can also be used to display other products. Generally, the cigar display system 600 comprises an enclosure 605, and at least one product tray 610 inside the enclosure 605.

The product tray 610 can be embodied as extendable display tray 110 or product display tray 500. The product tray 610 can thus generally comprise a base, a frame formed around the base, and a top sheet extending between two edges of the frame, the top sheet having a series of product stand holes formed therein. The product tray 610 can incorporate any other aspect of the display 110 and/or product tray 500 as disclosed herein.

The enclosure 605 can be configured as a transparent enclosure so that the products 615 in the enclosure 605 are visible from the outside. The enclosure 605 therefore can comprise a housing with vertical walls 620. The enclosure 605 can include a top 625 to enclose the top opening of the open ended housing. The top 625 can be removable. Similarly, enclosure can include a bottom 630 to enclose the bottom opening of the open ended housing. The bottom 630 can also be removable. The inside of the enclosure 605 can comprise a series of shelves 635. Two shelves 635 are illustrated in FIG. 6, but additional shelves 635 can be included in the enclosure 605 in other embodiments. The shelves 635 are configured to hold and display the product trays 610.

One side of the enclosure 605 can be configured as a door 640. The door 640 can be hinged on one side, and can include a latch 645 to secure the door 640 in a closed position. The closed enclosure 605 can further have a humidifier 650 disposed therein. The humidifier 650 can ensure the enclosure 605 stays at the desired level of humidity for the tobacco products 615 disposed therein.

The product display system 600 can further include a label 655. The label 655 is configured on the front 660 of the product tray 610. The label 655 can include a series of subsections. Each of the subsections can provide information such as name, characteristics, and price, related to the row of tobacco products 615 in the row directly behind the subsection of the label 655.

Figure 7A:
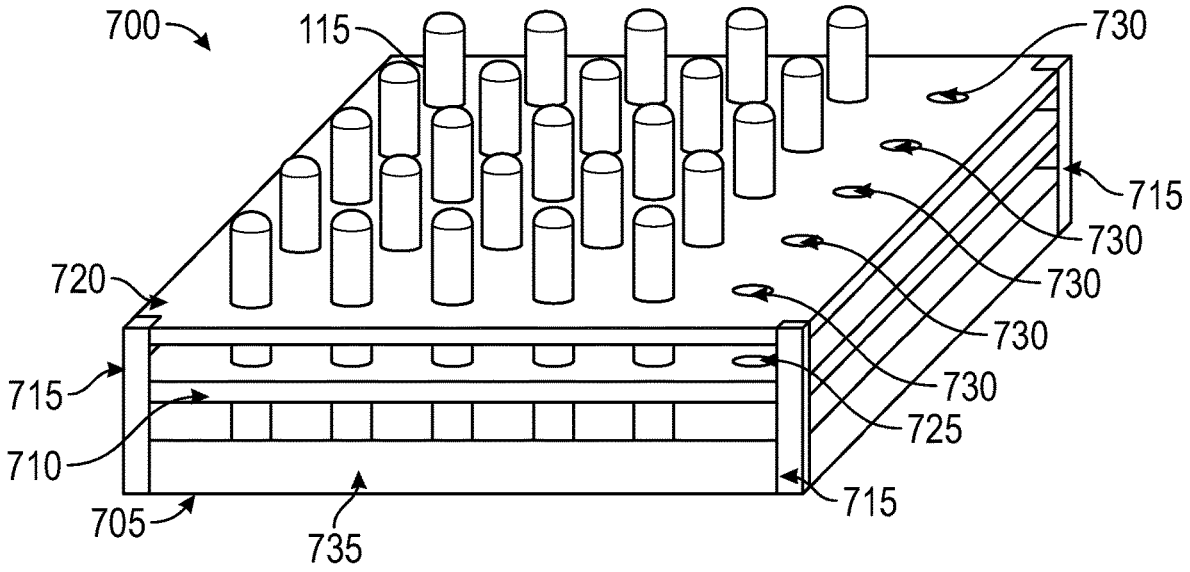
FIG. 7A depicts an alternative embodiment of a product display system, in accordance with the disclosed embodiments.

FIG. 7A illustrates another embodiment of a product display system 700 in accordance with the disclosed embodiments. The product display system 700 includes a base 705. In certain embodiments, the base 705 can comprise a series of slats configured to allow tobacco particles to filter out of the base for easy collection. In other embodiments, the base 705 can be a single piece. The base 705 can further comprise a frame 735. The frame 735 can enclose the base 705. In certain embodiments, the base 705 and frame 735 can be substantially equivalent to the base and frame described herein in other embodiments.

The base 705 and frame 735 can be attached to a first touch plate 710 and a second touch plate 720, with a series of corner pillars 715. The corner pillars 715 hold the first touch plate 710 above the base 705, and the second touch plate 720 above the first touch plate 710. The second touch plate 720 includes a plurality of mounting holes 730, through which a product 115 can be inserted. The mounting holes 730 can be arranged in an array, that can be in a variety of patterns as disclosed in other embodiments.

Figure 7B:
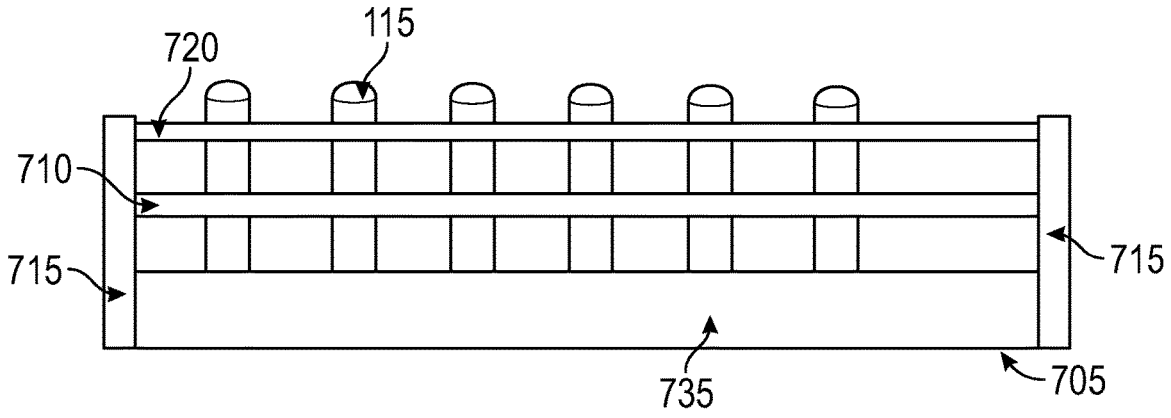
FIG. 7B depicts a side elevation view of an alternative embodiment of a product display system, in accordance with the disclosed embodiments.

The first touch plate 710 can be configured directly below the second touch plate 720, with a series of mounting holes 725. The mounting holes 725 can be configured to be directly below the mounting holes 730 in the second touch plate, such that a product 115 can be inserted through both mounting hole 730 in the second touch plate 720 and the mounting hole 725 in the first touch plate 710 directly below the mounting hole 730. In alternative embodiments, the alignment between a mounting hole 725 and mounting hole 730 can be slightly offset such that the product 115 inserted through the mounting hole 725 and mounting hole 730, is held at an angle or slant. The alignment of one or more of the sets of mounting hole 725 and mounting hole 730 can be selected to create angles or slants of the products inserted there through, to be aesthetically pleasing. FIG. 7B illustrates a side elevation view of the product display system 700.

Figure 8A:
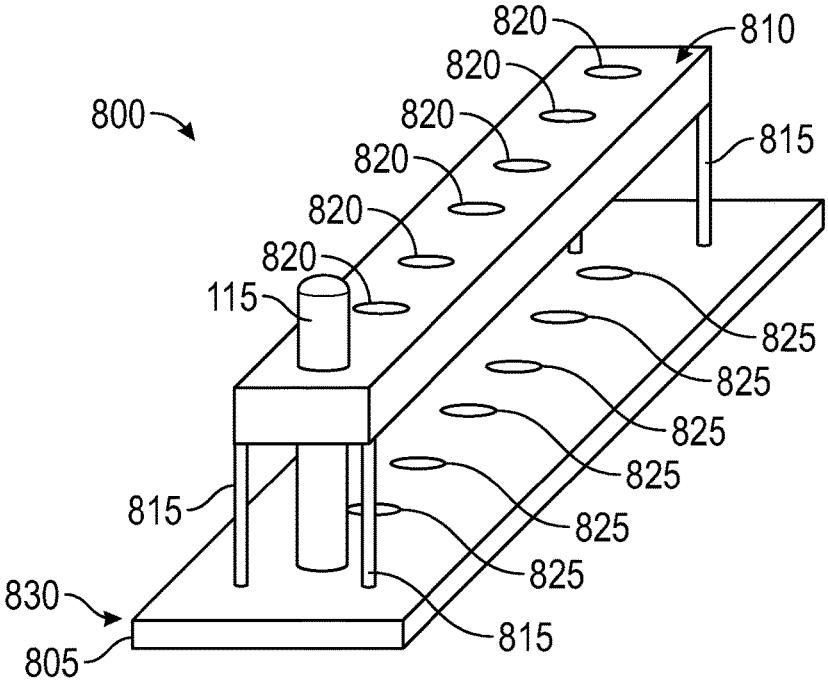
FIG. 8A depicts an alternative embodiment of a product display stand, in accordance with the disclosed embodiments.

FIG. 8A illustrates another embodiment of a product display stand system 800. The product display stand 800, can comprise a base 805 can comprise a series of slats configured to allow tobacco particles to filter out of the base for easy collection. In other embodiments, the base 805 can be a single piece. The base 805 can further comprise a frame 830. The frame 830 can enclose the base 805. In certain embodiments, the base 805 and frame 830 can be substantially equivalent to the base and frame described herein in other embodiments.

The base 805 and frame 830 can be attached to a raised display platform 810 with a series of corner pillars 815. The corner pillars 815 hold the raised display platform 810 above the base 705. The raised display platform 810 can include a plurality of mounting holes 820, through which a product 115 can be inserted. In FIG. 8A, the raised display platform 810 can include a single row of mounting holes 820. It should be appreciated that in other embodiments, the raised display platform 810 can be arranged with an array of mounting holes 820 as described in other embodiments, that can be in a variety of patterns as disclosed in other embodiments. The base 805 can further include a series of product indentions 825. The product indentions 825 can be arranged to be directly below the mounting holes 820, in the base 805, and can be configured to cradle the end of product 115.

Figure 8B:
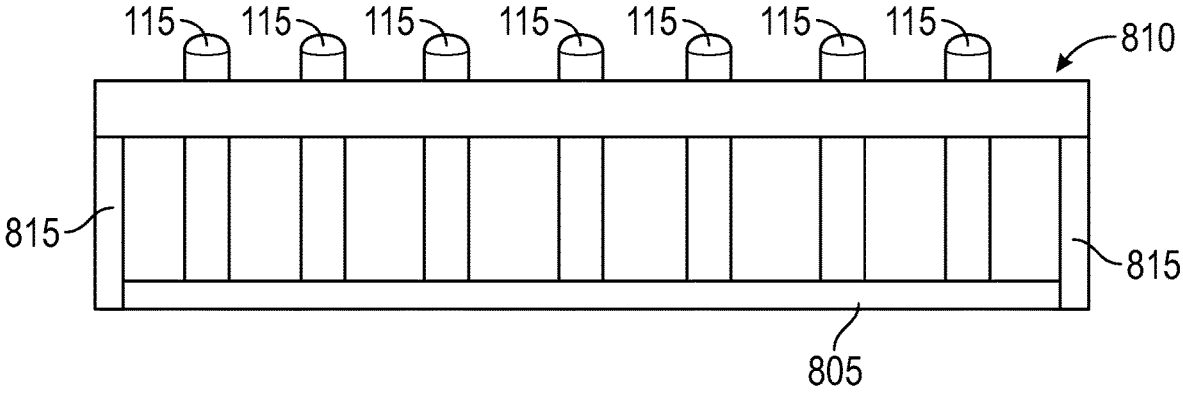
FIG. 8B depicts a side elevation view of an alternative embodiment of a product display stand, in accordance with the disclosed embodiments.

FIG. 8B illustrates a side elevation view of the product display stand system 800, with a selection of products 115 standing in the display system.

The embodiments disclosed herein can thus provide improved solutions for displaying tobacco products. The disclosed embodiments allow customers to easily browse a selection of cigars and choose those they would like to purchase, while providing the necessary conditions (e.g. temperature, humidity, aroma, etc.) to maintain the quality of the tobacco products.

The disclosed embodiments, make it much easier to view the cigar ring making it easy to identify the cigar. In addition, the embodiments do not require the customer to touch more than one of the cigars, thereby preventing the spread of disease. The disclosed displays further provide aesthetics that encourage a customer to purchase a cigar.

Furthermore, the disclosed embodiments make it easy for the store owner to track inventory. The product display is set to hold a given number of products, and the shop owner can easily verify how many products have been removed from the display. This allows the shop owner to cross check sales against products in the display to ensure products are not being stolen. The disclosed embodiments thus address a major challenge presented by traditional cigar display systems.

Based on the foregoing, it can be appreciated that a number of embodiments, preferred and alternative, are disclosed herein. For example, in an embodiment a product display system comprises a base, a frame formed around the base, and at least one display bar configured to sit on the base and inside the frame formed around the base, the display bar further comprising at least one tubular channel, the tubular channel being configured to hold a product for display.

In an embodiment, the at least one tubular channel comprises a plurality of tubular channels formed in a row on each of the plurality of display bars. In an embodiment, a depth of each of the plurality of tubular channels decreases sequentially from a front tubular channel among the plurality of tubular channels to a back tubular channel among the plurality of tubular channels. In an embodiment, the at least one display bar comprises a plurality of display bars, wherein the base and the frame are sized to house the plurality of display bars. In an embodiment, the plurality of display bars are arranged in the frame formed around the base such that the plurality of tubular channels form a grid of tubular channels. In an embodiment, the base further comprises a plurality of slats. In an embodiment, the at least one tubular channel is configured to have a diameter sized to fit a tobacco product.

In an embodiment, the product display system further comprises a humidor wherein the base, the frame formed around the base, and the at least one display bar are housed in the humidor. In an embodiment, the frame further comprises a first side rail, the first side rail having a first connecting arm mounted thereon, the first connecting arm configured to interface with a first mounting rail mounted in the humidor and a second side rail, the second side rail having a second connecting arm mounted thereon, the second connecting arm configured to interface with a second mounting rail mounted in the humidor.

In another embodiment, a product display system comprises a humidor, and an extendable display tray mounted in the humidor, the extendable display tray further comprising a base, a frame formed around the base, and a plurality of display bars arranged inside the frame formed around the base, each of the plurality of display bars comprising a row of tubular channels, each of the tubular channels being configured to hold a cigar vertically.

In an embodiment, the product display system further comprises a first connecting arm mounted to a side of the frame, the first connecting arm configured to interface with a first mounting rail mounted in the humidor and a second connecting arm mounted to an opposing side of the frame, the second connecting arm configured to interface with a second mounting rail mounted in the humidor.

In an embodiment, a depth of each of the plurality of tubular channels decreases sequentially from a front tubular channel among the plurality of tubular channels to a back tubular channel among the plurality of tubular channels.

In an embodiment, the base, the frame formed around the base, and the plurality of display bars arranged inside the frame formed around the base are made of wood. In an embodiment, a diameter of the tubular channels in each of the mounting blocks is different.

In yet another embodiment, a product display system comprises an enclosure and at least one product tray inside the enclosure, the product tray comprising a base, a frame formed around the base, and at least one top sheet extending between two edges of the frame, the at least one top sheet having at least one product stand hole formed therein. In an embodiment, the enclosure is transparent.

In an embodiment, the product display system further comprises a humidifier disposed in the enclosure.

In an embodiment, the at least one top sheet extending between two edges of the frame, comprises a plurality of top sheets each of the plurality of top sheets extending between the two edges of the frame.

In an embodiment, the product display system of further comprises at least two shelves formed inside the enclosure. In an embodiment, each of the at least two shelves houses one of the at least one product trays.

It will be appreciated that variations of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art which are also intended to be encompassed by the following claims.

What is claimed is:

1. A product display system comprising:

at least one display tray, the display tray comprising:

a base;

a frame formed around the base; and at least one removable display bar configured to sit on the base and inside the frame formed around the base, the at least one removable display bar further comprising at least one tubular channel, the at least one tubular channel being configured to hold a tobacco product vertically for display; and a humidor, wherein the at least one display tray is configured in the humidor, the humidor further comprising:

an enclosure with a transparent door;

a temperature and humidity control module configured to control temperature and humidity inside the humidor for the tobacco product; and at least one light configured to illuminate an interior of the humidor.

2. The product display system of claim 1 wherein the at least one tubular channel comprises a plurality of tubular channels formed in a row on each of the at least one removable display bar.

3. The product display system of claim 2 further comprising:

a cover configured over an opening of at least one of the plurality of tubular channels.

4. The product display system of claim 2 wherein the at least one removable display bar comprises a plurality of removable display bars, wherein the base and the frame are sized to house the plurality of removable display bars.

5. The product display system of claim 4 wherein the plurality of removable display bars are arranged in the frame formed around the base such that the plurality of tubular channels form a grid of tubular channels.

6. The product display system of claim 1 wherein the base further comprises:

a plurality of slats.

7. The product display system of claim 1.

8. The product display system of claim 7 wherein the frame further comprises:

a first side rail, the first side rail having a first connecting arm mounted thereon, the first connecting arm configured to interface with a first mounting rail mounted in the humidor; and a second side rail, the second side rail having a second connecting arm mounted thereon, the second connecting arm configured to interface with a second mounting rail mounted in the humidor.

9. The product display system of claim 1 wherein the at least one tubular channel is configured to have a diameter sized to fit a tobacco product.

10. A product display system comprising:

a humidor comprising:

an enclosure with a transparent door;

a temperature and humidity control module configured to control temperature and humidity inside the humidor for a tobacco product; and at least one light configured inside the humidor; and a display tray mounted in the humidor, the display tray further comprising:

a base;

a frame formed around the base;

a first connecting arm mounted to a side of the frame, the first connecting arm configured to interface with a first mounting rail mounted in the humidor;

a second connecting arm mounted to an opposing side of the frame, the second connecting arm configured to interface with a second mounting rail mounted in the humidor; and a series of separators inserted into the frame, the display tray being configured to hold the tobacco product vertically.

11. The product display system of claim 10 wherein:

the first connecting arm further comprises a first upper rib, a first lower rib, and a first roller; and the second connecting arm further comprises a second upper rib, a second lower rib, and a second roller.

12. The product display system of claim 10 further comprising:

at least one display bar configured to sit on the base and inside the frame formed around the base.

13. The product display system of claim 12 wherein the base, the frame, and the at least one display bar arranged inside the frame are made of wood.

14. The product display system of claim 10 wherein the tobacco product comprises a cigar.

15. A product display system comprising:

a transparent enclosure for displaying tobacco products;

a humidifier configured inside the transparent enclosure configured to maintain a humidity level for the tobacco products;

at least one shelf in the enclosure; and at least one product tray inside the enclosure, the at least one product tray comprising:

a base configured with slats;

a frame formed around the base;

at least one label configured on the at least one product tray; and at least one top sheet extending between two edges of the frame, wherein the at least one product tray is configured to vertically display tobacco products.

16. The product display system of claim 15 wherein a door of the enclosure is transparent.

17. The product display system of claim 15 further comprising:

a first touch plate;

a second touch plate;

at least two corner pillars, the at least two corner pillars configured to hold the first touch plate above the base, and the second touch plate above the first touch plate.

18. The product display system of claim 15 wherein the at least one top sheet extending between two edges of the frame, comprises a plurality of top sheets each of the plurality of top sheets extending between the two edges of the frame.

19. The product display system of claim 15 further comprising:

at least two shelves formed inside the enclosure.

20. The product display system of claim 19 wherein each of the at least two shelves houses one of the at least one product tray.

* * * * *